US011667440B2

(12) United States Patent
Collis et al.

(10) Patent No.: US 11,667,440 B2
(45) **Date of Patent: *Jun. 6, 2023**

(54) SECURABLE CLIP

(71) Applicant: SAFESEAL-SYSTEMS, Palm Harbor, FL (US)

(72) Inventors: Ronald Collis, Palm Harbor, FL (US); James Ryan Bowen, Clearwater, FL (US)

(73) Assignee: SAFESEAL-SYSTEMS, Palm Harbor, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/943,173

(22) Filed: Sep. 12, 2022

(65) Prior Publication Data

US 2023/0002119 A1 Jan. 5, 2023

Related U.S. Application Data

(63) Continuation of application No. 17/338,742, filed on Jun. 4, 2021, now Pat. No. 11,472,605.
(Continued)

(51) Int. Cl.
*B65D 33/16* (2006.01)
*B65D 33/00* (2006.01)
(Continued)

(52) U.S. Cl.
CPC ..... *B65D 33/1675* (2013.01); *A44B 19/00* (2013.01); *B21D 39/00* (2013.01);
(Continued)

(58) Field of Classification Search
CPC ..... B65D 33/1675; B65D 33/004; B65D 2203/06; B65D 2203/10; B65D 2211/00; B65D 2401/15; B65D 2401/25
See application file for complete search history.

(56) References Cited

U.S. PATENT DOCUMENTS 3,551,965 A 1/1971 Gordon
3,717,369 A 2/1973 Stoffel et al.
(Continued)

FOREIGN PATENT DOCUMENTS

EP 2390196 3/2014
FR 2771387 A1 5/1999
(Continued)

OTHER PUBLICATIONS

Safeseal-Systems, International Application No. PCT/US2021/035816 filed Jun. 4, 2021; International Search Report and Written Opinion; ISA/US; dated Sep. 27, 2021; 9pp.
(Continued)

*Primary Examiner* — Jermie E Cozart
(74) *Attorney, Agent, or Firm* — FisherBroyles LLP; Anthony Dovale

(57) ABSTRACT

A securable clip includes a first elongated rectangular portion and a second elongated rectangular portion connected along a common edge. The clip includes at least one locking peg, at least one receiving hole configured to receive the at least one locking peg, and a frangible portion. The frangible portion provides a visual indication that the clip has been opened. The releasing of the locking peg prevents the clip from being reclosed, reused, or sealed again.

14 Claims, 14 Drawing Sheets

Related U.S. Application Data

(60) Provisional application No. 63/034,944, filed on Jun. 4, 2020, provisional application No. 63/034,948, filed on Jun. 4, 2020, provisional application No. 63/034,953, filed on Jun. 4, 2020.

(51) Int. Cl.
*A44B 19/00* (2006.01)
*B21D 39/00* (2006.01)

(52) U.S. Cl.
CPC ..... *B65D 33/004* (2013.01); *B65D 2203/06* (2013.01); *B65D 2203/10* (2013.01); *B65D 2211/00* (2013.01); *B65D 2401/15* (2020.05); *B65D 2401/25* (2020.05)

(56) References Cited

U.S. PATENT DOCUMENTS

| | | | | |
|---|---|---|---|---|
| 4,296,529 | A | 10/1981 | Brown | |
| 4,441,223 | A | 4/1984 | Swift | |
| 4,656,697 | A | 4/1987 | Naslund | |
| 5,008,980 | A | 4/1991 | Zimmermann | |
| 5,050,272 | A | 9/1991 | Robinson | |
| 5,375,300 | A | 12/1994 | Chen | |
| 5,379,489 | A | 1/1995 | Delk | |
| 5,428,871 | A | 7/1995 | Iosif | |
| 5,713,108 | A | 2/1998 | Solomon | |
| 6,904,646 | B2 | 6/2005 | Reynolds | |
| 7,062,822 | B2 | 6/2006 | Folkmar | |
| 7,284,303 | B2 | 10/2007 | Canegallo et al. | |
| 8,196,442 | B1 | 6/2012 | Lassen et al. | |
| 10,807,772 | B2 | 10/2020 | Ruddell | |
| 11,472,605 | B2 * | 10/2022 | Collis | B65D 33/004 |
| 2002/0133916 | A1 | 9/2002 | Folkmar | |
| 2013/0305540 | A1 | 11/2013 | Ruddell | |
| 2016/0232767 | A1 | 8/2016 | Yang | |

FOREIGN PATENT DOCUMENTS

| | | |
|---|---|---|
| JP | 2013513531 | 4/2013 |
| WO | 1988/02727 A1 | 4/1988 |
| WO | 2018/028233 A1 | 2/2018 |

OTHER PUBLICATIONS

"Biodegradable self sealing black box self adhesive strip tear shipping packaging box brown quick seal postal box" Publisher: Shenzhen Sinmenda Packaging Co., Ltd 1999-2021.
"Custom logo corrugated peel off self seal postal zipper mailing mailer boxes adhesive tear strips box" Publisher: Impression Packaging Products (Guangzhou) Co., Ltd. URL Link: 1999-2021.
"Tear strip boxes" Publisher: Alibaba.com URL link: 1999-2021.
"Bag sealer clip" Jiaxing; 2021.
"Food Bag Sealer Clips" Publisher: straightbuy 2020.
"Tamper-evident A5-size Envopak Reusable security bags" Publisher: Envopak; 2021.
"Pull seal" Publisher: Alta Max; 2021.
"Security Seals : Plastic, Metal or Cable Seals"; Publisher: Jiji.ng; 2021.

* cited by examiner

FIG. 6B
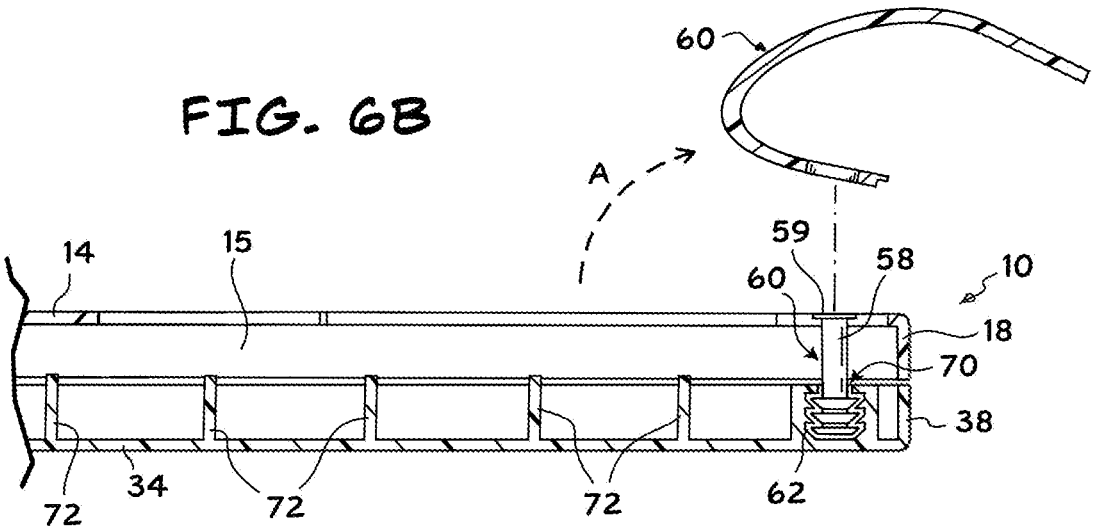
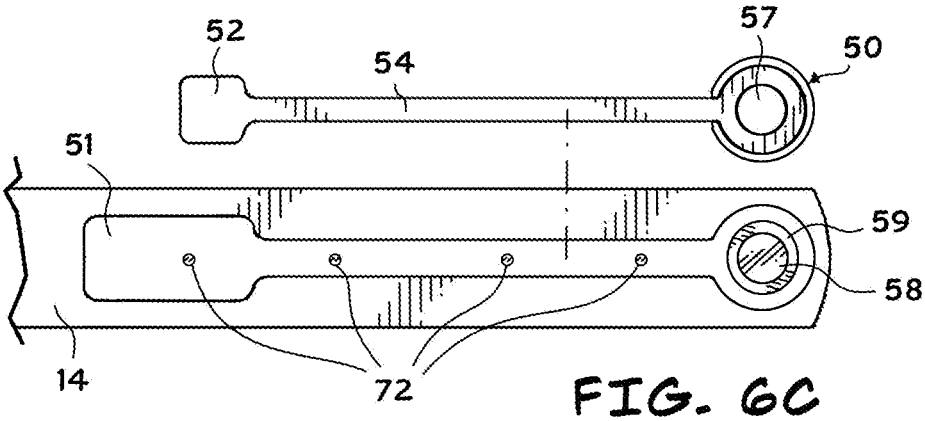
FIG. 6C
FIG. 7
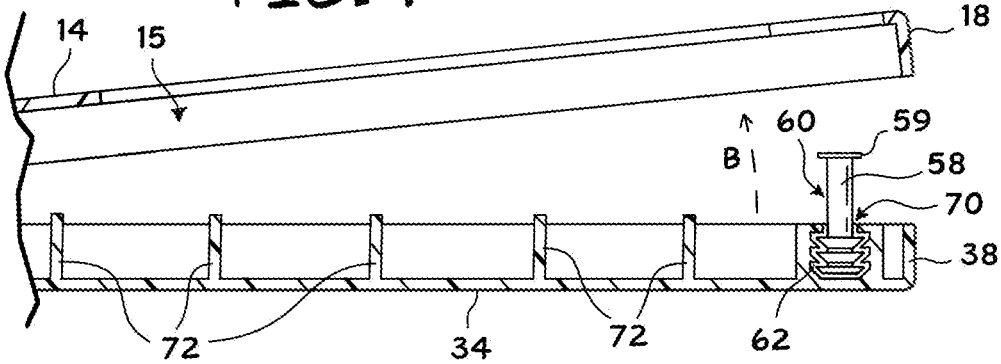

SECURABLE CLIP

Delivery of prepared food and fresh grocery items has become increasingly popular. However, once the food or item has left the restaurant, grocery store, or other seller, opportunities abound for intentional or accidental tampering of the food or other item. Tampering of the food or other item, or simply exposing the contents, not only impacts the safety/quality/quantity available, but these instances increase operational and customer service-related costs for both the delivery service and the supplier. Further still, the coronavirus pandemic has heightened awareness of the chain of custody of items prepared (e.g., food from restaurants, hotels, entertainment venues, cruise lines, etc.), gathered (e.g., delivery services that shop at grocery stores on other's behalf), and packaged (e.g., prescription drug deliveries). A secure and economical secure mechanism for transport of food and other items is needed.

BRIEF DESCRIPTION OF THE DRAWINGS

The accompanying drawings, which are incorporated herein and constitute part of this specification, illustrate exemplary embodiments of the disclosure, and, together with the detailed description below, serve to explain features of the disclosure. In the drawings:

FIG. 6B is a cross sectional view similar to FIG. 6A with the removable tab entirely removed from the clip of the first embodiment.

FIG. 6C is a top view of the clip of the first embodiment with the removable tab entirely separated from the clip.

FIG. 7 is a cross section view of the clip of the first embodiment being opened in direction B after the removable tab is entirely removed.

DETAILED DESCRIPTION

Figure 1A:
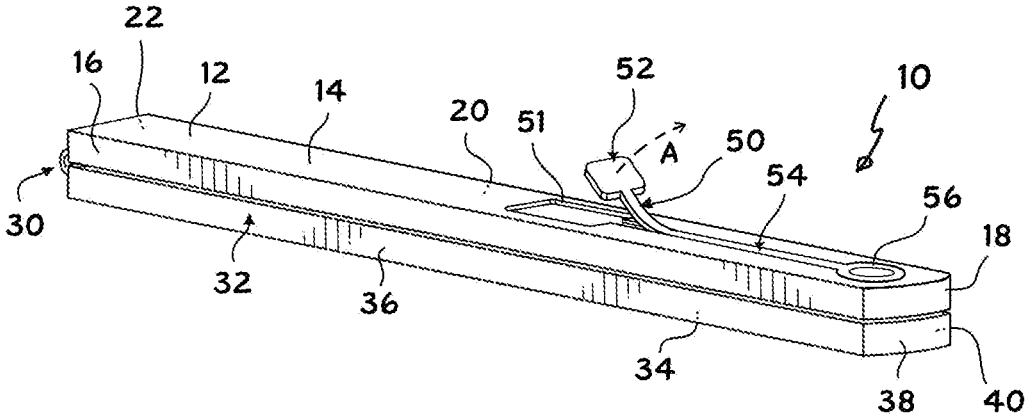
FIG. 1A is a perspective view of a first embodiment of a clip.

In the drawings, like numerals indicate like elements throughout. Certain terminology is used herein for convenience only and is not to be taken as a limitation on the present disclosure. The terminology includes the words specifically mentioned, derivatives thereof and words of similar import. The embodiments illustrated below are not intended to be exhaustive or to limit the disclosure to the precise form disclosed. These embodiments are chosen and described to best explain the principles, application and practical use, and to enable others skilled in the art to best utilize the disclosure.

In one aspect, the exemplary embodiments shown herein provide a secure delivery mechanism to eliminate tampering and accidental exposure to contaminants, such as for food, items, and other deliverables. Among other benefits, the exemplary embodiments detailed herewithin eliminate tampering from food or other items, especially during delivery, until the food or other items are delivered to the intended recipient. While food, prescription drugs, money, groceries, etc. are discussed herein, benefits of the exemplary embodiments can be realized to secure food or other items from touching, contaminating, or otherwise impacting in any manner anything sensitive or personal before an intended recipient accesses the delivery mechanism. Some conventional scenarios that could be addressed and/or eliminated by utilizing the exemplary embodiments can include:

Example 1) A food delivery driver sampling food in transit.

Example 2) A food delivery driver opening a bag or container to examine contents therein, and touching, adjusting, or other otherwise contaminating the food in transit.

Example 3) A food delivery driver opening a bag or container to examine contents and, even if the contents are not physically touched, contaminate the food by allowing dust, bacteria, or any particulate into the open bag or container.

Example 4) An employee transporting money, e.g., from a store to a bank to make a deposit, could eliminate suspicion of the employee if the count is off on either end.

Example 5) A package may accidentally be dropped, shaken, shifted suddenly, or fall off the car seat in transit and therefore open the box and expose the contents.

Additionally, the exemplary embodiments can help retain confidence in products delivered to ensure security and can help save resources and costs by creating accountability for the supplier/sender and the transporting party and personnel. In at least one aspect, the exemplary embodiments can be secured for delivery and only opened by the intended recipient. For example, if a vendor applies the secure delivery mechanism upon completing an order before the order is picked up for delivery, at least the following benefits are recognized:

The sender (e.g., a vendor) cannot claim that the transporter is responsible for any items missing from the order.

The intended recipient cannot claim the transporter tampered with the order.

In at least one aspect, the exemplary embodiments provide a secure system for the transporting party to essentially guarantee that the food/item left the restaurant/store (e.g., vendor) in the condition received by the intended recipient. Additionally, this secure system eliminates the delivery driver, or the company employing the delivery driver, from blame if the food/item order as delivered is incorrect.

Figure 1B:
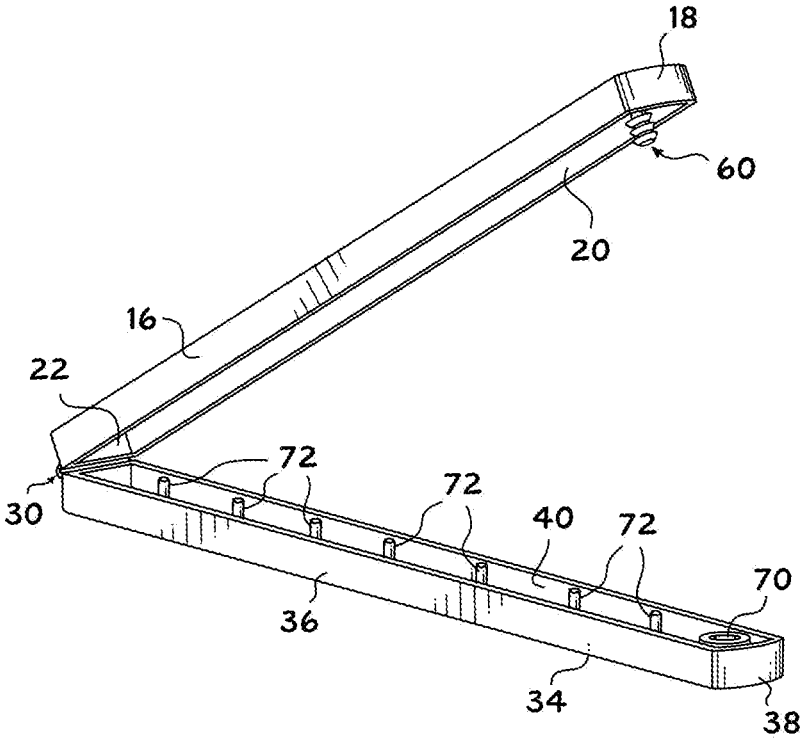
FIG. 1B is a perspective view of the first embodiment with the clip open.

FIG. 1A is a perspective view of a first embodiment of a clip. As shown in FIG. 1A, a clip 10 includes two substantially rectangular portions 12, 32 connected along a hinge 30. Portion 12 is shown in FIG. 1A as the upper portion of the clip, but this orientation is exemplary only. Portion 12 includes an upper surface 14, side surfaces 16 and 20, and end surfaces 18 and 22. Portion 32 includes a bottom surface 34, side surfaces 36 and 40, and end surfaces 38 and 42. A removable tab is shown at 50 and includes a pull tab 52 adjacent a space 51 (FIG. 4) provided to allow entry of an object, such as a finger, to initiate separation of removable tab 50 with pull tab 52. The removable tab 50 includes an extensible portion 54, shown as a substantially rectangular length extending in upper surface 14 between pull tab 52 and post connection 56. When removed, the removable tab 50 is detached in direction A. FIG. 1B is a perspective view of the first embodiment with the clip open.

Figure 2:
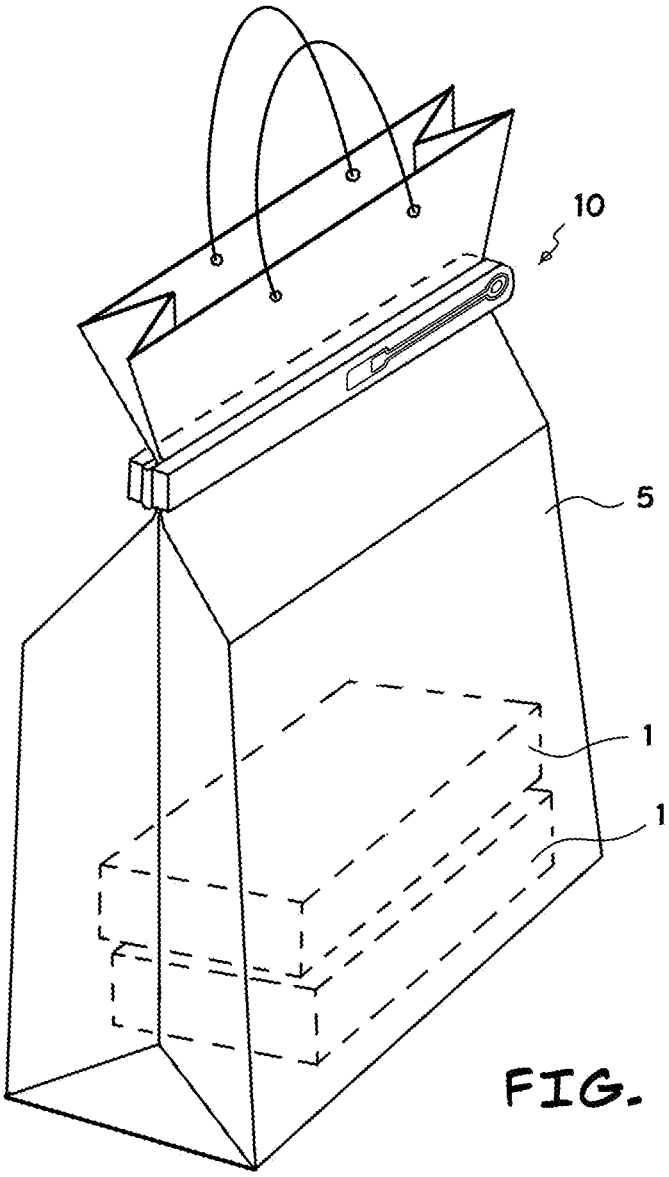
FIG. 2 is a perspective view of the clip of the first embodiment in an exemplary use secured to a bag enclosing an item therewithin.

FIG. 2 shows a perspective view of the clip of the first embodiment in an exemplary use with the clip being secured to a bag 5 that is enclosing item 1 there within.

Figure 3A:
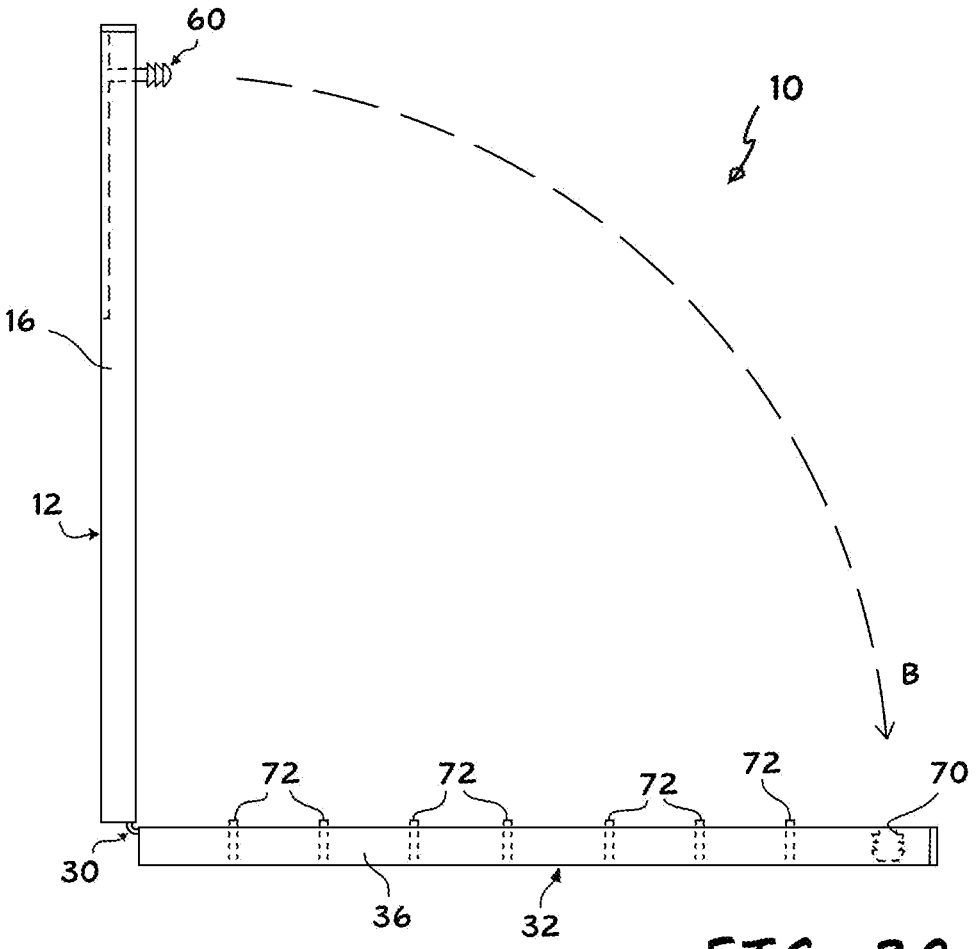
FIG. 3A is a side elevational view of the clip of the first embodiment in an open position.
Figure 3B:
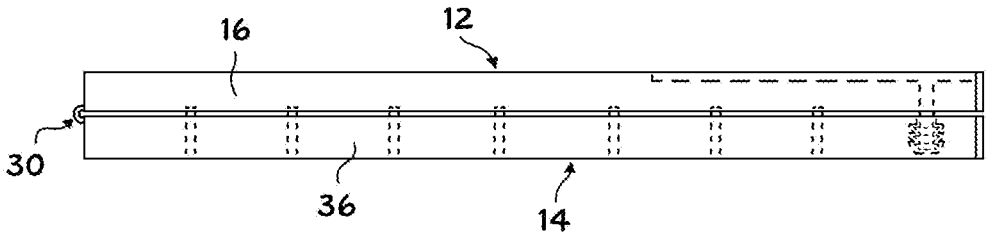
FIG. 3B is a side elevational view of the clip of the first embodiment in a closed/secured position.

FIG. 3A is a side elevation view of the clip of the first embodiment closing from an open position in direction B. As shown in FIG. 3A, portion 12 includes a post base 60, which is shown with a threaded body. Portion 32 includes a receiving opening 70 and retaining feature 72. FIG. 3B shows the clip of the first embodiment entirely closed with post base 60 being inserted entirely within receiving opening 70.

Figure 4:
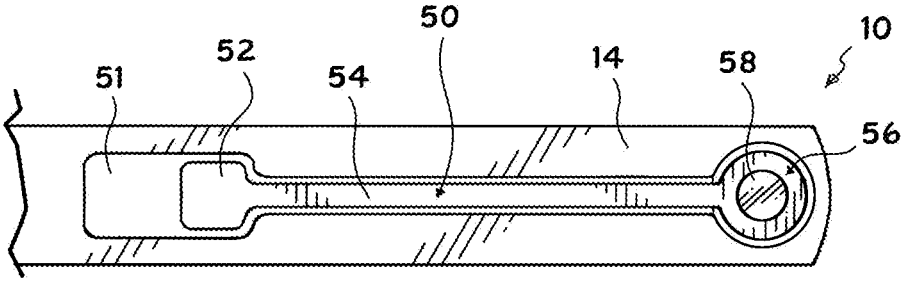
FIG. 4 is a top view of the removable tab on the top of the clip of the first embodiment.

FIG. 4 shows a top view of removable tab 50 on the upper surface 14 of the first portion 12 of the clip 10 of the first embodiment. In addition to showing the pull tab 52, opening 51, extensible portion 54, and post connection 56, FIG. 4 also shows the top 58 of the post.

Figure 5:
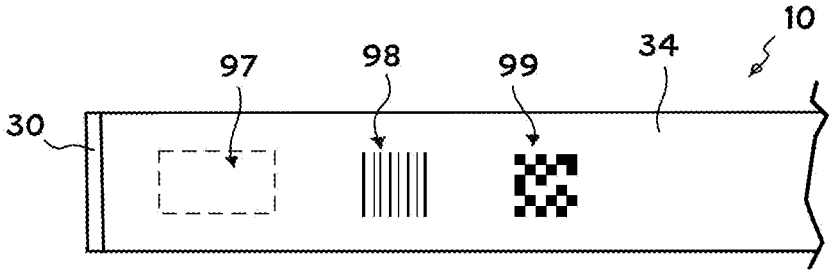
FIG. 5 is a bottom view of the hinge and the clip of the first embodiment.

FIG. 5 shows the bottom surface 34 of the hinge 30 and the clip 10 of the first embodiment. As shown in FIG. 5, additional, optional features can be provided, including, e.g., trackable features, for example, tracking device 97, barcode 98, and QR code 99.

Figure 6A:
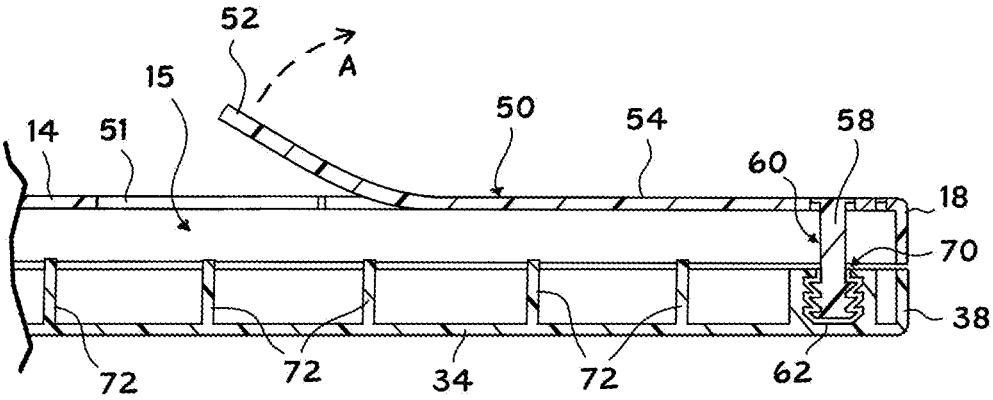
FIG. 6A is a cross sectional view taken along lines 4-4 of FIG. 1 showing initial removal of the removable tab.

FIG. 6A shows the clip 10 of the first embodiment with the removable tab 50 being engaged for removal. As shown in FIG. 6A, the pull tab 52 is engaged by inserting a finger or other object into opening 51 and pulling the tab 52 in direction A. In this manner, the pull tab 52 begins separation of the removable tab 50 from upper surface 14 along extensible portion 54.

FIG. 6B shows the clip 10 of the first embodiment with the removable tab 50 entirely removed from clip 10. FIG. 6C shows the removable tab 50 entirely separated from the clip 10, with the removable tab 50 adjacent to upper surface 14 of portion 12. As shown in FIG. 6C, the removable tab 50 was separated from the top 58 of the post at an opening 57 in the removable tab 50 leaving a remainder portion 59 on the post 58. Additionally, retaining features 72 are shown in FIG. 6C in a cylindrical orientation. The retaining features 72 providing extensions that assist in retaining the bag or other container in clip 10 when the clip 10 is in the closed position. The retaining feature 72 can extend into space 15 of portion 12 in the closed position.

FIG. 7 shows the clip 10 with the removable tab 50 being separated entirely therefrom and with the clip 10 being opened in a direction C. As shown in FIG. 7, the post 58 is retained in portion 32 after post base 60 was received in opening 70 and with threads 62 engaging corresponding portions of opening 72 to assist in the retention of post 58. The portion 12 includes an opening 15 as shown in the cross-sectional view of FIG. 7.

Figure 8A:
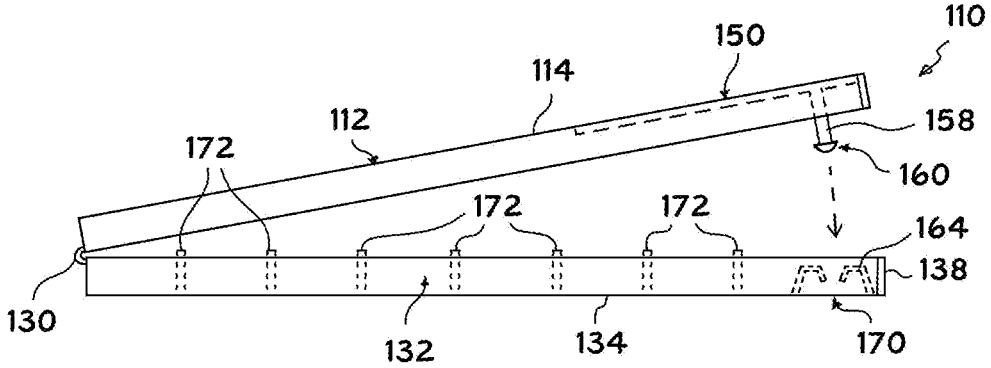
FIG. 8A is a second embodiment of a clip.

FIG. 8A shows a side view of a second embodiment of a clip 110. As shown in FIG. 8A, the clip 110 includes a portion 112 and a portion 132 connected along a hinge 130. The portion 112 includes an upper surface 114 in which a removable tab 150 is disposed. The removable tab 150 includes a post 158 extending therefrom and a post base 160. The portion 132 includes retaining features 172 extending upwardly which are receivable in opening 115 of portion 112 when the clip 110 is closed. As shown in FIG. 8A, the portion 112 is being closed toward portion 132 along hinge 130 in the direction C. The lower portion 132 further includes a receiving opening 170 including a retention feature 164.

Figure 8B:
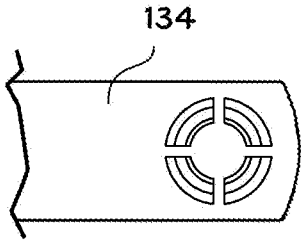
FIG. 8B is a bottom view of the clip of the second embodiment.

FIG. 8B is a bottom view of the clip 110 of the second embodiment. As shown in FIG. 8B, the bottom surface 134 includes receiving opening 170 and retention feature 164.

Figure 8C:
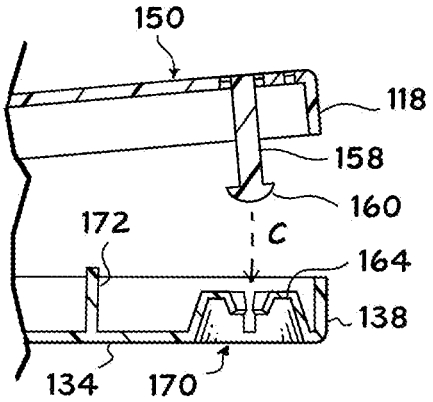
FIG. 8C is a cross sectional view of the second embodiment with the clip being closed.
Figure 8D:
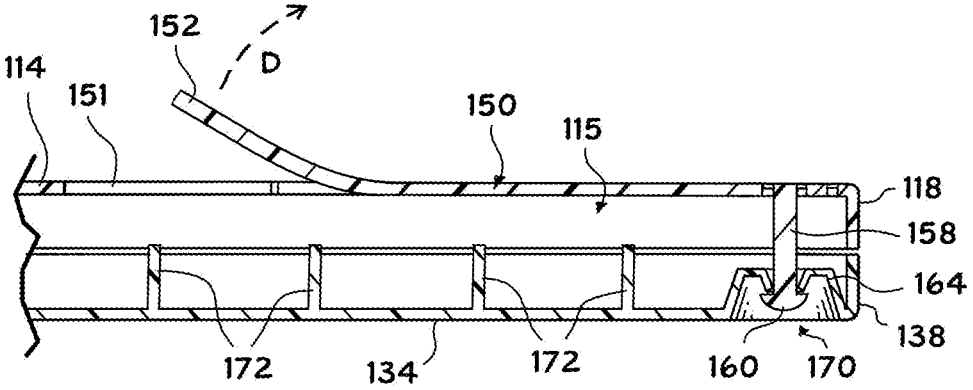
FIG. 8D is a cross sectional view of the second embodiment with the clip closed and the removable tab being engaged.
Figure 8E:
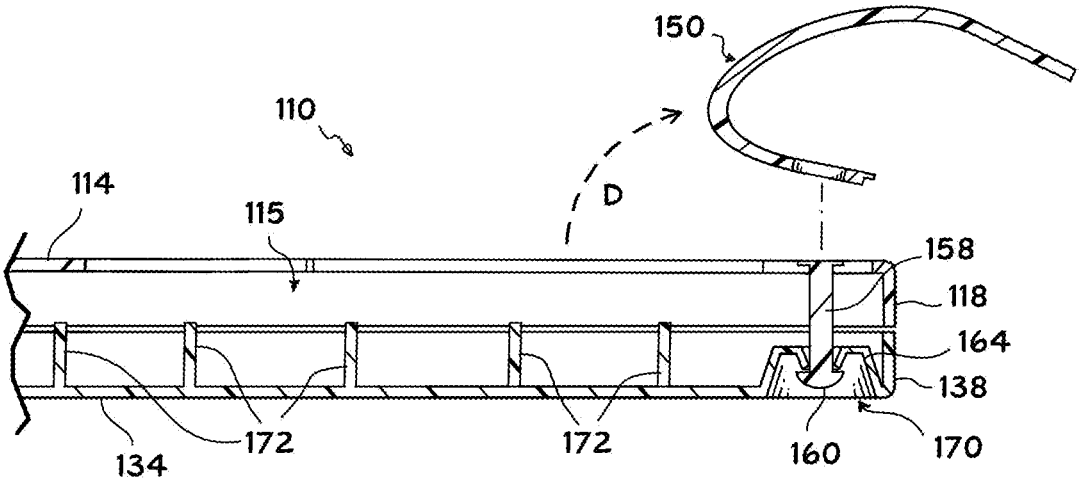
FIG. 8E is a cross sectional view of the second embodiment with the removable tab fully detached.
Figure 8F:
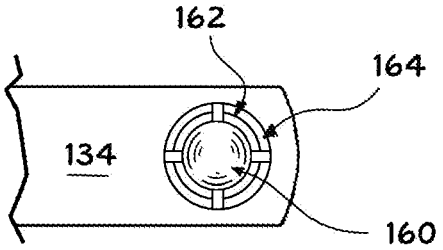
FIG. 8F is a bottom view of the clip of the second embodiment with the post retained and the removable tab fully detached.

FIG. 8C shows a cross-sectional view of the second embodiment with the clip 110 closed. FIG. 8D shows a cross-sectional view of the second embodiment with clip 110 entirely closed and with removable tab 150 being engaged at pull tab 152 by inserting a finger or other object into opening 151. The removable tab 150 is removed in direction D as shown in FIG. 8*d*. FIG. 8*e* shows the removal tab 150 being removed entirely in the direction d from the clip 110. FIG. 8F shows a bottom view of the clip 110 of the second embodiment with the post base 160 being retained in the opening 170 by retention features 164.

Figure 9A:
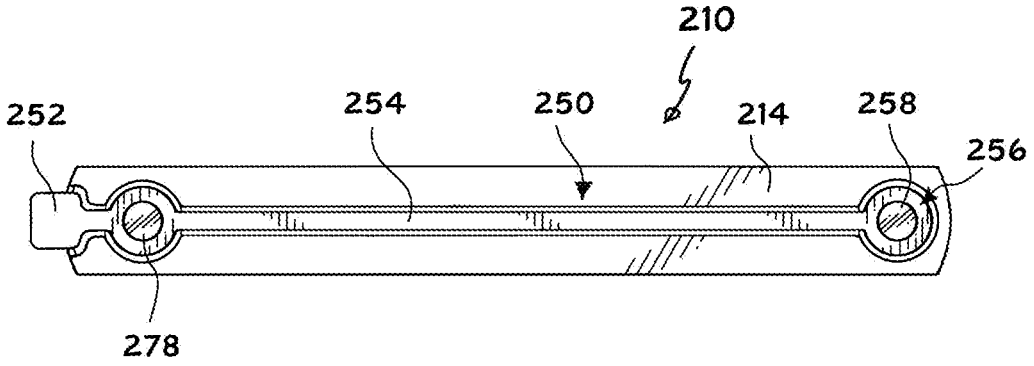
FIG. 9A is a plan view of a third embodiment of the clip with two posts and without a hinge.

FIG. 9A is a plan view of a third embodiment of a clip 210 that includes two posts 258 and 278, but does not include a hinge. As shown in FIG. 9A, a removable tab 150 is provided with a pull tab 152 disposed at a first end and extending past the rectangular portions of clip 210. The removable tab 250 further includes an extensible portion 254 and post connection 256. The removable tab 250 is shown in upper surface 214 of clip 210.

Figure 9B:
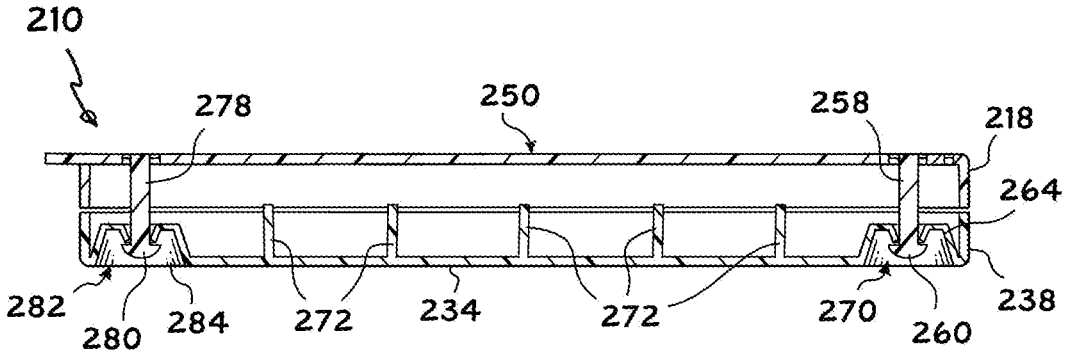
FIG. 9B is a cross sectional view of the third embodiment with the clip closed.
Figure 9C:
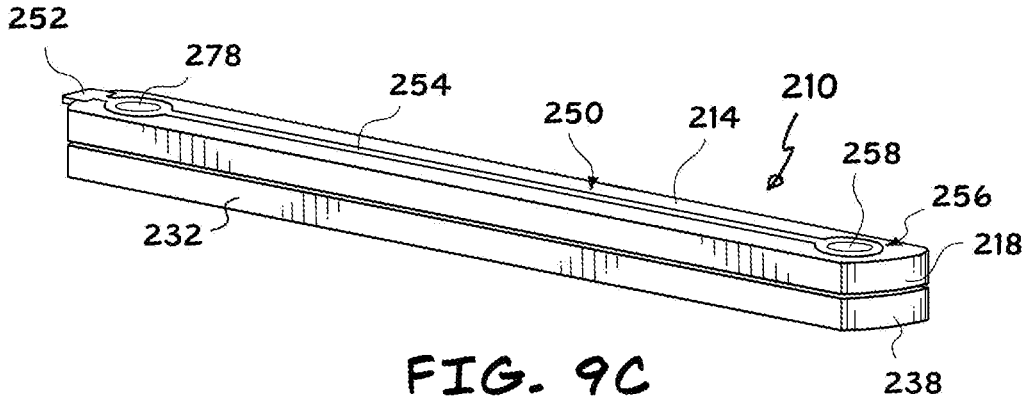
FIG. 9C is a perspective view of the third embodiment.

FIG. 9B is a cross section view of the third embodiment of the clip 210 closed. As shown in FIG. 9B, the clip 210 shows both posts 258 and 278 engaged in the closed position. FIG. 9C is a perspective view of the third embodiment.

Figure 10A:
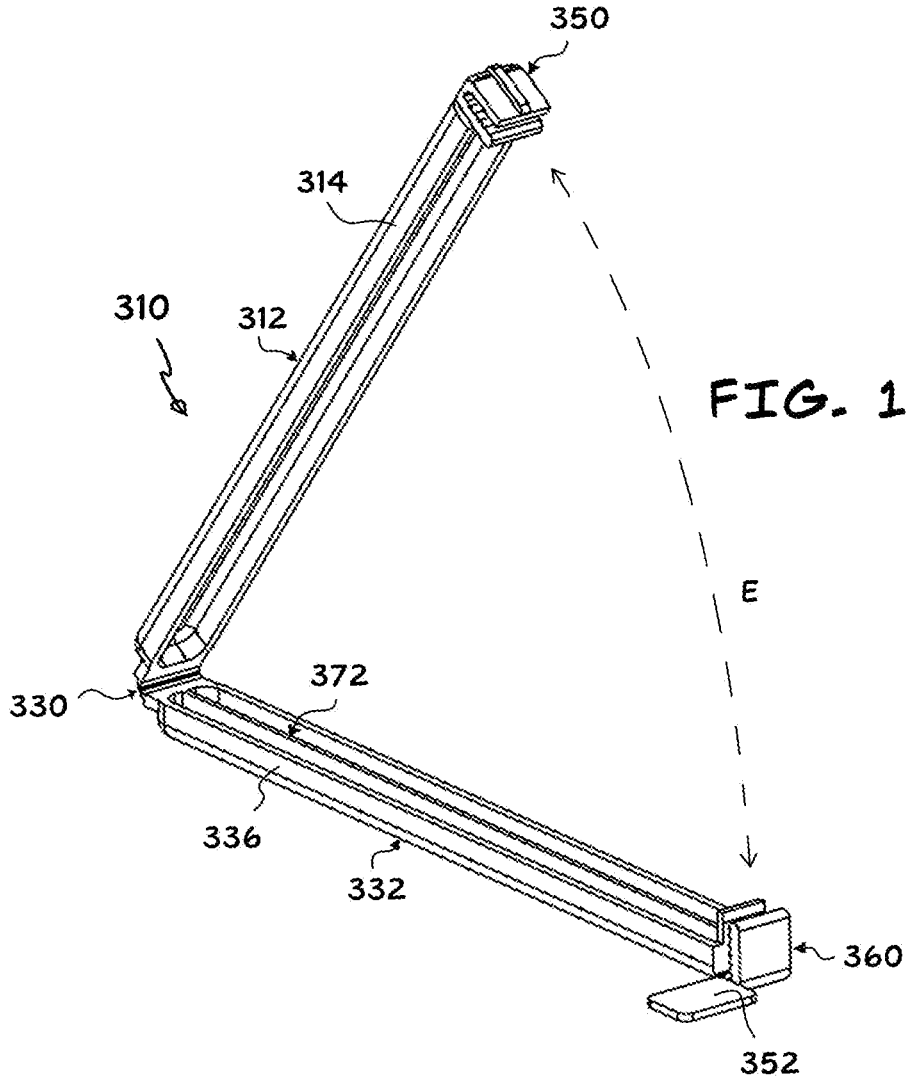
FIG. 10A is a perspective view of a fourth embodiment of a clip.

FIG. 10A is a perspective view of a fourth embodiment of a clip 310. As shown in FIG. 10A, the clip 310 includes a portion 312 with front wall 314. Portion 312 is connected along a hinge 330 to portion 332. Portion 332 includes a sidewall 336 and retention feature 372. A securing feature is formed by engagement of a first securing portion 350, which is attached to portion 312 and, second securing portion 360, which is attached to portion 332. Second securing portion 360 includes a removable tab 352. First securing portion 350 and second securing portion 360 are sized to mate securely with one another. Portion 312 and portion 332 are engageable to hinge along hinge 330 in the direction E, which is shown as including upward and downward arrows for movement in either direction as desired.

Figure 10B:
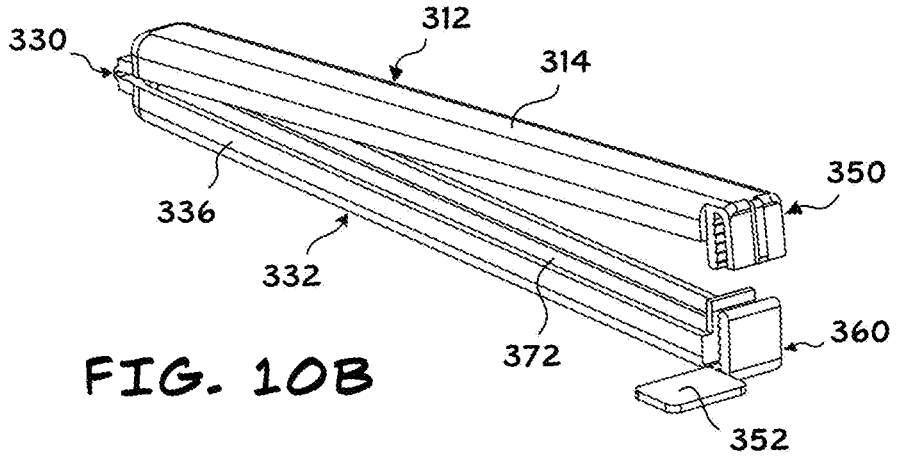
FIG. 10B is a perspective view of the fourth embodiment of the clip being closed.
Figure 10C:
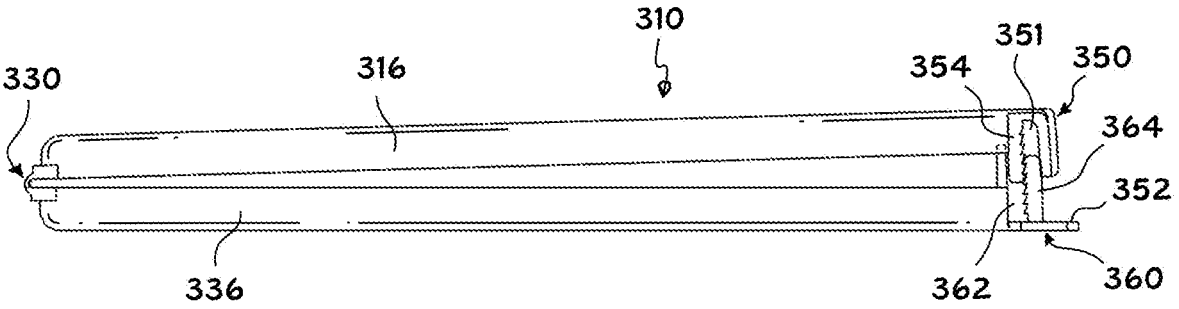
FIG. 10C is a side elevational view of the fourth embodiment of the clip being closed.
Figure 10D:
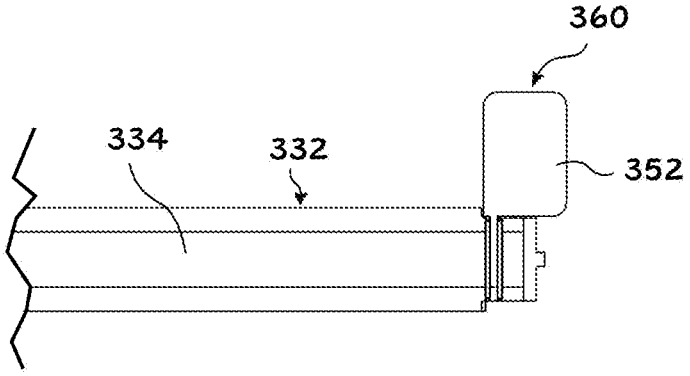
FIG. 10D is a bottom view of the fourth embodiment of the clip.
Figure 10E:
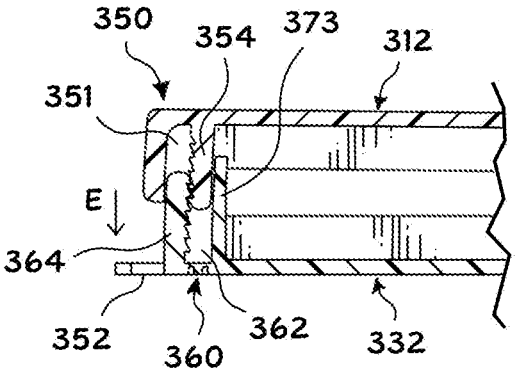
FIG. 10E is a cross sectional view of the fourth embodiment of the clip being closed.

FIG. 10B shows the clip 310 being moved in a direction E with portion 312 and portion 332 closing together about hinge 330. FIG. 10C shows a continuation of the clip closing with first securing portion 350 including a portion 354 with teeth or other serrated grooves formed therein that interact with teeth or other serrated grooves formed in portion 364, which is part of second securing portion 360. Upon engagement of the teeth of portion 354 with the teeth of portion 364, gap 351 of first securing portion 350 and gap 362 of second securing portion 360 are closed. FIG. 10D shows a bottom view of the fourth embodiment of the clip 310. Portion 332 of FIG. 10D shows bottom surface 334 and an underside of pull tab 352 of portion 360. FIG. 10E shows a cross section of the fourth embodiment with the clip being closed. A remainder portion 373 of second securing portion 360 is shown in FIG. 10D.

Figure 11A:
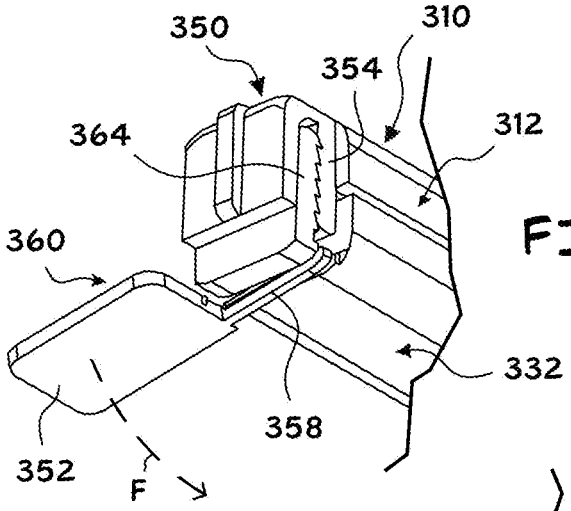
FIG. 11A is a lower perspective view of the fourth embodiment of the clip with the pull tab being detached.

FIG. 11A is a lower perspective view of the fourth embodiment of the clip 310 with the pull tab 352 being detached in a direction F. As shown, pull tab 352 is detached from portion 332 along extensible portion 358. As shown in 11A, gaps 351 and 362 have been entirely closed with the teeth of portion 354 and portion 364 being engaged to securely close clip 310.

Figure 11B:
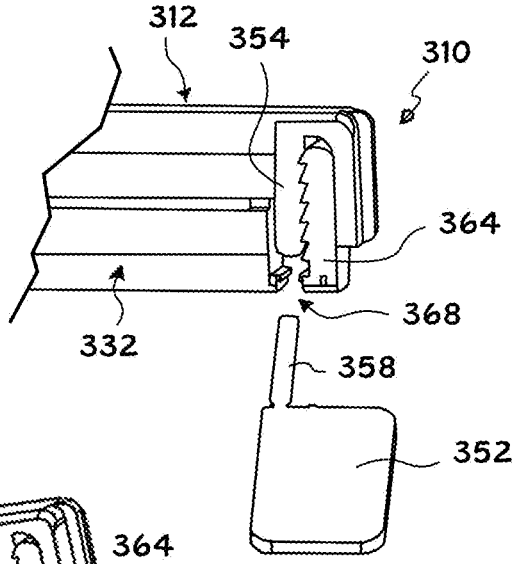
FIG. 11B is a side elevational view of the fourth embodiment of the clip with the pull tab entirely detached.

FIG. 11B is a side elevation view of the fourth embodiment of the clip 310 with the pull tab 352 entirely detached. The removal of the pull tab 32 also detaches extensible portion 358. A gap 368 is formed between the portion 332 and second securing portion 360.

Figure 11C:
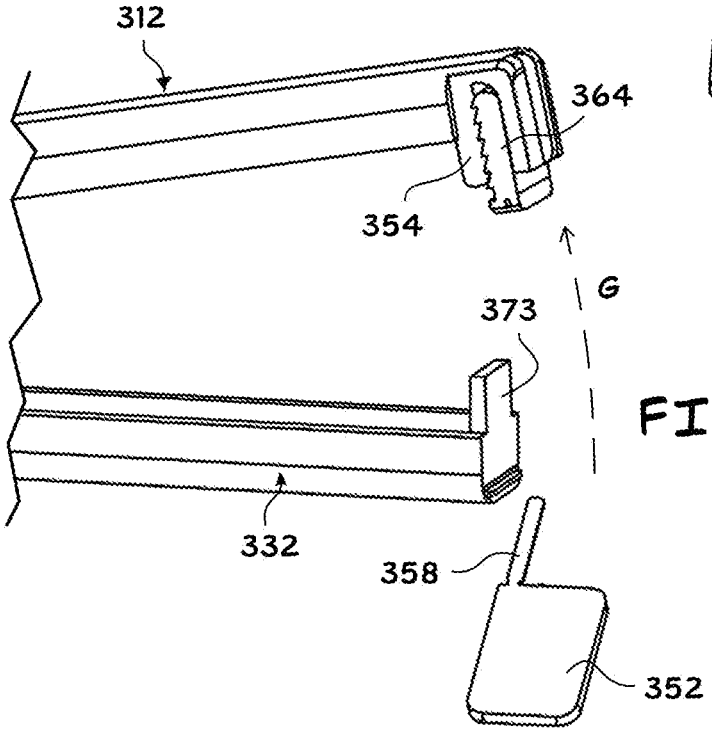
FIG. 11C is a side perspective view of the fourth embodiment of the clip with the pull tab entirely detached and with the clip being opened.

FIG. 11C is a side perspective view of the fourth embodiment of the clip 310 with pull tab 352 entirely detached and with the clip 310 being opened. The clip 310 as shown in FIG. 11C is opened in a direction G with portion 312 being separated from portion 332 and allowing access to contents previously secured by clip 310. As shown further in FIG. 11C, portion 332 retains remainder portion 373 with the attached portions 364 of second securing portion 360 and 354 of first securing portion 350 remaining securely attached and moving in the direction G with portion 312.

Figure 12:
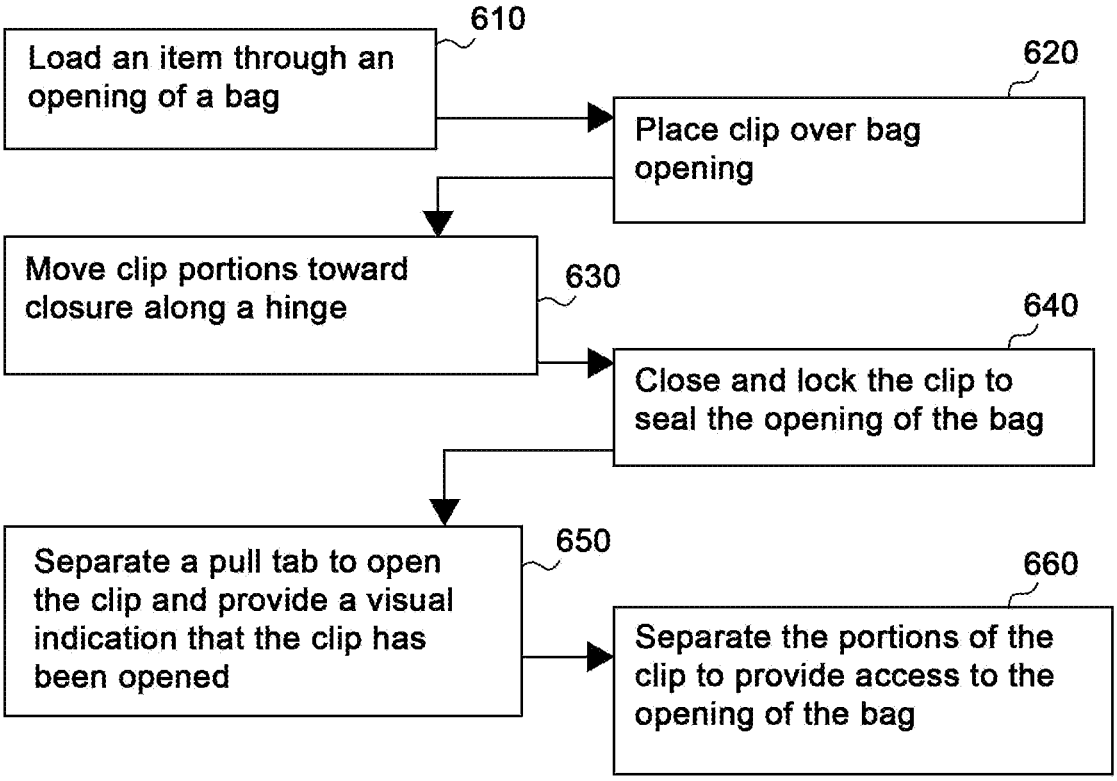
FIG. 12 shows an exemplary method of use of an exemplary clip according to the first, second, and fourth embodiments.

FIG. 12 shows an exemplary method of use of an exemplary clip according to the first, second, and fourth embodiments. First, at step 610, an item is loaded into a bag through an opening of the bag. At step 620, a clip is placed over the bag in a position to close the opening. At step 630, portions of the clip are moved toward engagement with one another by hinging one portion of the clip toward the other portion of the clip to close the clip around the opening of the bag. At step 640, the clip is closed to lock the clip in place and securely seal the clip. At step 650, the clip is opened by separating a pull tab, with the separation of the pull tab providing a visual indication that the secured clip has been opened. At step 660, the portions of the clip are separated to provide access to the opening of the bag.

Figure 13:
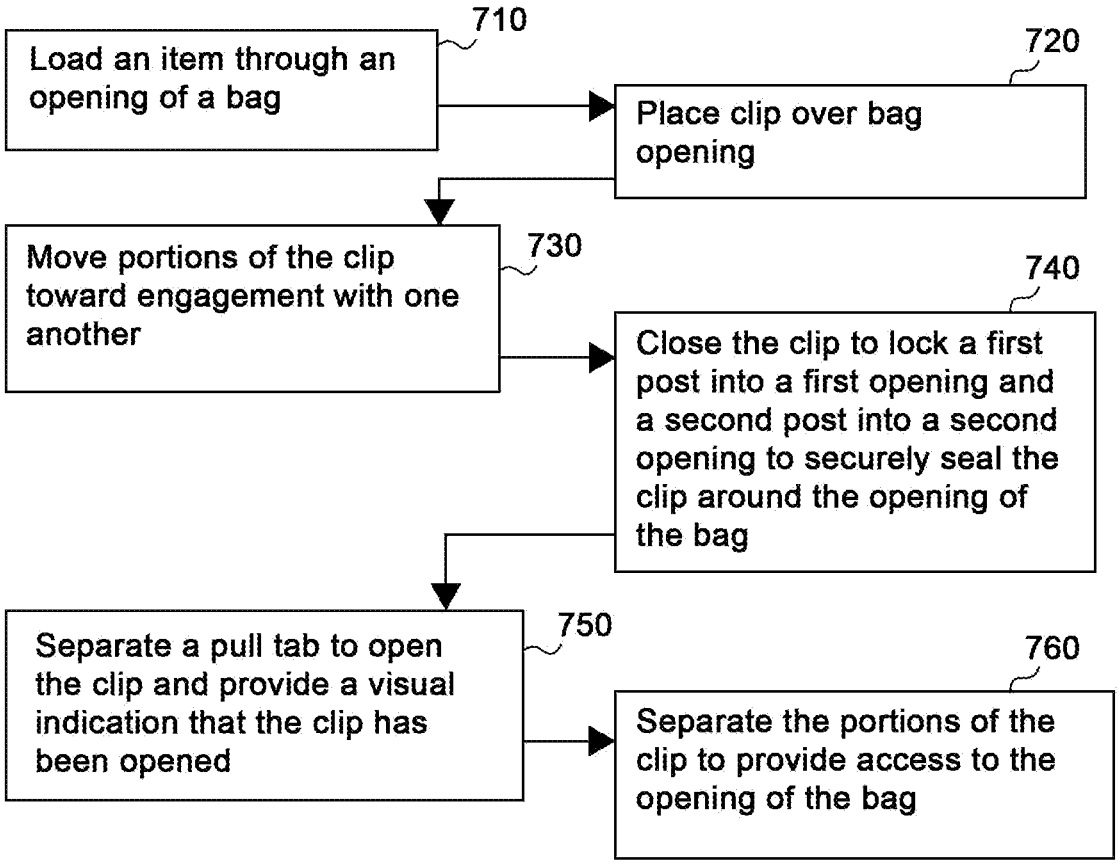
FIG. 13 shows an exemplary method of use of an exemplary clip according to the third embodiment.

FIG. 13 shows an exemplary method of use of an exemplary clip according to the third embodiment. First, at step 710, an item is loaded into a bag through an opening of the bag. At step 720, a clip is placed over the bag in a position to close the opening. At step 730, portions of the clip are moved toward engagement with one another to close the clip around the opening of the bag. At step 740, the clip is closed to lock a first post with a first opening and a second post with a second opening to securely seal the clip. At step 750, the clip is opened by separating a pull tab, with the separation of the pull tab providing a visual indication that the secured clip has been opened. At step 760, the portions of the clip are separated to provide access to the opening of the bag.

Figure 14A:
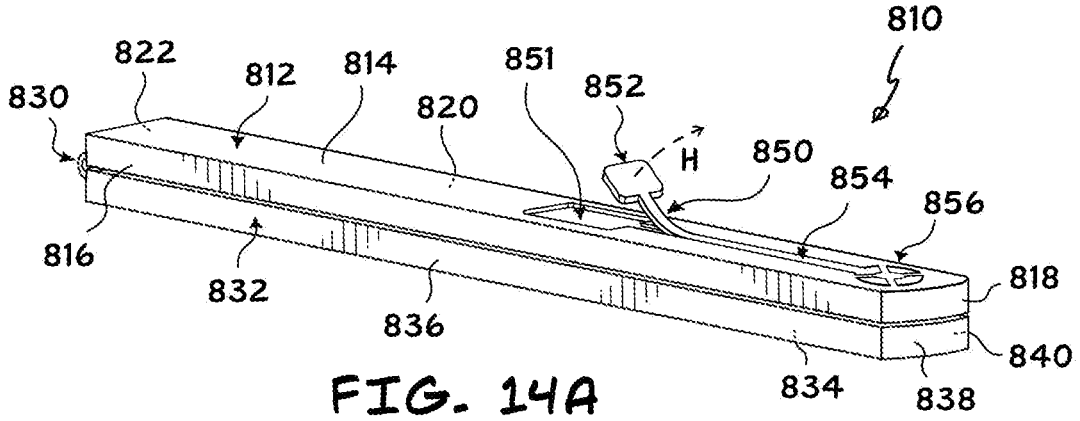
FIG. 14A is a perspective view of a fourth embodiment of a clip.
Figure 14B:
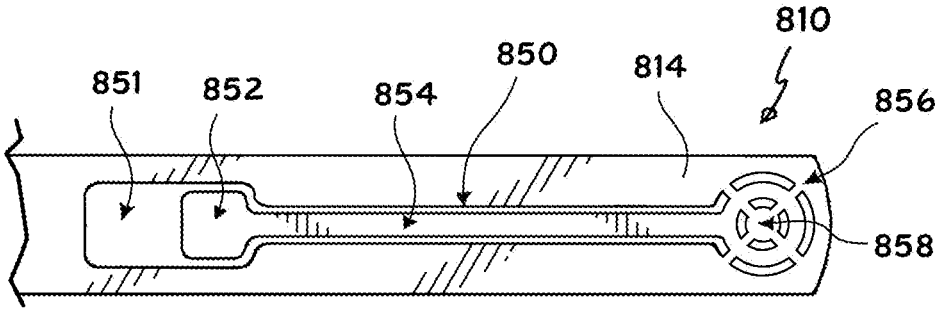
FIG. 14B is a top view of the removable tab on the top of the clip of the fourth embodiment.
Figure 14C:
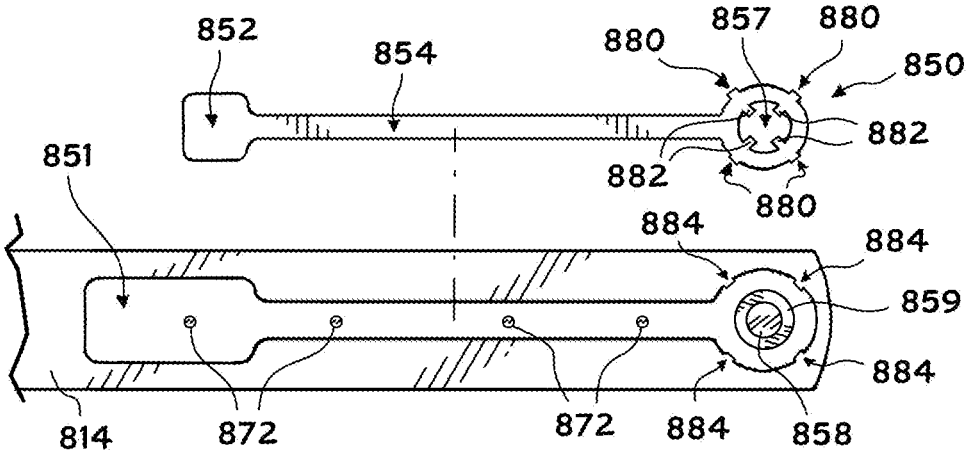
FIG. 14C is a top view of the clip of the fourth embodiment with the removable tab entirely separated from the clip.

FIG. 14A is a perspective view of a fourth embodiment of a clip. FIG. 14B is a top view of the removable tab on the top of the clip of the fourth embodiment. FIG. 14C is a top view of the clip of the fourth embodiment with the removable tab entirely separated from the clip. FIGS. 14A, 14B, and 14C include locator tabs, which can provide extra strength and can help keep the peg and tab intact, such as when closing the clip. As shown in FIG. 14A, a clip 810 includes two substantially rectangular portions 812, 832 connected along a hinge 830. Portion 812 is shown in FIG. 14A as the upper portion of the clip, but this orientation is exemplary only. Portion 812 includes an upper surface 814, side surfaces 816 and 820, and end surfaces 818 and 822. Portion 832 includes a bottom surface 834, side surfaces 836 and 840, and end surfaces 838 and 842. A removable tab is shown at 850 and includes a pull tab 852 adjacent a space 851 provided to allow entry of an object, such as a finger, to initiate separation of removable tab 850 with pull tab 852. The removable tab 850 includes an extensible portion 854, shown as a substantially rectangular length extending in upper surface 814 between pull tab 852 and post connection 856. When removed, the removable tab 850 is detached in direction H.

FIG. 14B shows a top view of removable tab 850 on the upper surface 814 of the first portion 812 of the clip 810 of the fourth embodiment. In addition to showing the pull tab 852, opening 851, extensible portion 854, post connection 856, and the top 858 of the post.

FIG. 14C shows the removable tab 850 entirely separated from the clip 810, with the removable tab 850 adjacent to upper surface 814 of portion 812. As shown in FIG. 14C, the removable tab 850 was separated from the top 858 of the post at an opening 857 in the removable tab 850 leaving a remainder portion 859 on the post 858. Additionally, retaining features 872 are shown in FIG. 14C in a cylindrical orientation. The retaining features 872 provide extensions that assist in retaining the bag or other container in clip 810 when the clip 810 is in the closed position. The retaining feature 872 can extend into space 815 of portion 812 in the closed position. Locator tabs 880 and 882 are shown around opening 857 and, when removed, uncover remainder portions 884.

The exemplary clips detailed herein can prevent tampering or other exposure of the contents of a sealed container or bag before being delivered and opened by the intended recipient or authorized user. Additionally, the exemplary clips detailed herein prevent accidental exposure and possible contamination while the sealed container is in transit by preventing the package from opening due to unexpected events, e.g., the bag/clip being dropped or the delivery vehicle making a sudden stop and the sealed bag/clip shifting, tipping, or falling.

The exemplary clips detailed herein will allow any person not trained or skilled in securing packages or bags or food, to seal or secure items in a way that renders bags and clips tamper resistant. Further, the exemplary clips detailed herein can be closed and opened only once, thus making the exemplary clips detailed herein single use or one-time-use. The exemplary clips detailed herein include a "pull tab" or "tear away tab" which removes the material holding a locking peg to the clip, and therefore releases the peg from an initial or original place in the clip and allows the clip to be opened. The locking pegs are not easily restored to the initial position as material generally is removed from the peg by pull tab making it visibly evident that a clip has been opened. The exemplary clips detailed herein can be used on any bag or any container capable of receiving the exemplary clips, including, for example: bags, satchels, sacks, purses, envelopes, etc. The bags/items being sealed can be made of paper, plastic, fabric, or any other material. The exemplary clips detailed herein can be used to secure/seal; one, or multiple bags/items. The exemplary clips detailed herein can be formed of any material capable of allowing the clips to function as detailed herein, but generally will be formed of plastic to allow the removable tab or pull tab to be flexible for detachment from another portion of the clip. In some cases, the peg(s) can pierce through the item being sealed. Optionally, as desired in other embodiments, a separate tool or device such as a hole punch, can be used to create hole(s) for the pegs. The peg can include tiered barbs/ribs to make the clip adjustable in a way, that in it can hold more layers of, and or thicker material in general, of the bags/items being sealed.

Although not shown in the exemplary figures, in at least one embodiment, the clip with or without a hinge could include three or more pegs and corresponding peg receivers. Additional pegs/receivers may be needed to secure lengthier versions of the clip. In at least one embodiment, the clip can use one pull tab to release every or all peg(s). In at least one embodiment, the clip can could use a separate pull tab to release each peg individually. Optionally, in at least one embodiment, the pull tab could release the peg receiver instead of the peg. In at least one embodiment, the pull tab could release multiple/all peg receivers.

In at least one embodiment, the clip can incorporate barcodes, RFID tags, microchips, or any other technology for the purpose of tracking the clip and item(s) being sealed. Tracking can record either of, or any of the following data points; time, location, contents of items, names and contact information of the sender/shipper/merchant, the delivering/transporting party and any other intermediaries, and the intended recipient/customer.

In at least one embodiment, the exemplary clips detailed can include a hole or tunnel therethrough for adding an additional layer of security by providing an opening for a zip tie or other locking mechanism. Additionally, a hole or tunnel could also be used for storing and organizing the clips before use, e.g., with the use of a string, ring, or rod. Further, the holes could also be used to string or strap a number of closed clips together to make transportation easier.

The exemplary clips detailed herein can be formed of any applicable method, including, for example, single injection molding, or could be manufactured in separate molds—with the pegs and/or peg receivers being separately manufactured and then attached to the clip. In one exemplary design, the pegs and peg receivers could be inserted into pre built-in holes, allowing extra strength and security to be added as needed. Further, in at least one exemplary embodiment, if the manufactured pegs and/or peg receivers are separately manufactured, the pegs could be permanently glued or heat sealed to the clips in a two-step manufacturing process.

The present disclosure can be understood more readily by reference to the instant detailed description, examples, and claims. It is to be understood that this disclosure is not limited to the specific systems, devices, and/or methods disclosed unless otherwise specified, as such can, of course, vary. It is also to be understood that the terminology used herein is for the purpose of describing particular aspects only and is not intended to be limiting.

The instant description is provided as an enabling teaching of the disclosure in its best, currently known aspect. Those skilled in the relevant art will recognize that many changes can be made to the aspects described, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the instant description is provided as illustrative of the principles of the present disclosure and not in limitation thereof.

As used herein, the singular forms "a," "an" and "the" include plural referents unless the context clearly dictates otherwise. Thus, for example, reference to a "body" includes aspects having two or more bodies unless the context clearly indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

Although several aspects of the disclosure have been disclosed in the foregoing specification, it is understood by those skilled in the art that many modifications and other aspects of the disclosure will come to mind to which the disclosure pertains, having the benefit of the teaching presented in the foregoing description and associated drawings. It is thus understood that the disclosure is not limited to the specific aspects disclosed hereinabove, and that many modifications and other aspects are intended to be included within the scope of the appended claims. Moreover, although specific terms are employed herein, as well as in the claims that follow, they are used only in a generic and descriptive sense, and not for the purposes of limiting the described disclosure.

What is claimed is:

1. A method of securing a clip, the method comprising:

providing a clip comprising a first rectangular portion and a second rectangular portion, the first rectangular portion includes a frangible portion and at least one locking peg extending from an interior surface and the second rectangular portion including at least one receiver;

hinging the clip closed with the at least one locking peg being received in the at least one receiver;

separating the frangible portion at least partially from the clip;

wherein separation of the frangible portion removes part of the first rectangular portion and provides a visual indication that the frangible portion has been at least partially separated from the first rectangular portion.

2. The method of claim 1 wherein, once opened, the frangible portion cannot be reattached to the first rectangular portion.

3. The method of claim 1 wherein the frangible portion includes a pull tab.

4. The method of claim 3 wherein the pull tab is sized to be detached to remove a portion of the clip to allow the first rectangular portion to release the at least one locking peg.

5. The method of claim 4 wherein, once released, the at least one locking peg is unable to be relocked to the clip.

6. The method of claim 1 wherein at least one identifier is provided to allow the clip to be tracked.

7. The method of claim 6 wherein the at least identifier is chosen from: a barcode, a QR code, or RFID tag.

8. The method of claim 6 wherein the at least one identifier indicates at least one of: order information, timestamp, supplier information, recipient information, promotional message(s), removal instructions, and any combination thereof.

9. The method of claim 1 wherein the first rectangular portion is hinged to the second rectangular portion.

10. The method of claim 9 wherein a bag, sack, or other container can be closed by the clip.

11. The method of claim 10 wherein the bag, sack, or other container is secured between the first rectangular portion and the second rectangular portion when the clip is closed.

12. The method of claim 1 wherein a bag, sack, or other container can be closed by the clip.

13. The method of claim 12 wherein the bag, sack, or other container is secured between the first rectangular portion and the second rectangular portion when the clip is closed.

14. The method of claim 1 wherein a bag, sack, or other container is secured between the first rectangular portion and the second rectangular portion when the clip is closed.

* * * * *